US012305392B2

(12) United States Patent
Schnobrich et al.

(10) Patent No.: US 12,305,392 B2
(45) Date of Patent: May 20, 2025

(54) DRYWALL AND METHOD FOR CONSTRUCTING A DRYWALL

(71) Applicant: KNAUF GIPS KG, Iphofen (DE)

(72) Inventors: Ruth Schnobrich, Würzburg (DE); Klaus Holfelder, Iphofen (DE); Klaus Wandler, Rödelsee (DE)

(73) Assignee: KNAUF GIPS KG, Iphofen (DE)

( * ) Notice: Subject to any disclaimer, the term of this patent is extended or adjusted under 35 U.S.C. 154(b) by 262 days.

(21) Appl. No.: 17/756,702

(22) PCT Filed: Dec. 20, 2019

(86) PCT No.: PCT/EP2019/000353

§ 371 (c)(1),
(2) Date: May 31, 2022

(87) PCT Pub. No.: WO2021/121535

PCT Pub. Date: Jun. 24, 2021

(65) Prior Publication Data

US 2022/0412086 A1 Dec. 29, 2022

(51) Int. Cl.

| | |
|---|---|
| ***E04C 2/38*** | (2006.01) |
| ***E04B 2/00*** | (2006.01) |
| ***E04C 2/52*** | (2006.01) |

(52) U.S. Cl.

CPC ..... *E04C 2/384* (2013.01); *E04C 2/46* (2013.01); *E04C 2/521* (2013.01)

(58) Field of Classification Search

CPC ..... E04C 2/384; E04C 2/46; E04C 2/521
USPC ..... 52/481.1
See application file for complete search history.

(56) References Cited

U.S. PATENT DOCUMENTS

| | | | | |
|---|---|---|---|---|
| 2,321,568 | A | 6/1943 | Wilson | |
| 2,878,529 | A | 3/1959 | Dupler | |
| 3,948,011 | A * | 4/1976 | Price | E04B 2/7409 411/921 |

(Continued)

FOREIGN PATENT DOCUMENTS

| | | | |
|---|---|---|---|
| DE | 102005016995 | B3 | 8/2006 |
| GB | 1446205 | A | 8/1976 |
| WO | 2013189855 | A | 12/2013 |

OTHER PUBLICATIONS

Communication received for European Application No. 19835349.2, dated Feb. 8, 2024.

(Continued)

*Primary Examiner* — James J Buckle, Jr.
(74) *Attorney, Agent, or Firm* — Greer, Burns & Crain, Ltd

(57) ABSTRACT

A drywall including a first wall section and a second wall section, as well as a support structure. The support structure includes first stud elements. In the area of the first wall section, the first stud elements are arranged in a row with first distances and form first support structure bays. A paneling with planking panels is arranged on at least one side of the support structure, and an installation duct is arranged in a second wall section. The support structure has, in the area of the second wall section, a first and a second crossbeam, which, to form the installation duct, form a second support structure bay which extends across at least two first support structure bays that are arranged next to each other. The invention further concerns a method for erecting a drywall.

20 Claims, 5 Drawing Sheets

(56) References Cited

U.S. PATENT DOCUMENTS 3,958,372 A * 5/1976 Benbow ..... E04F 13/12 52/36.6
4,068,434 A * 1/1978 Day ..... B32B 15/046 52/404.3
4,330,921 A * 5/1982 White, Jr. ..... B27M 3/0073 52/404.3
4,370,838 A * 2/1983 Vermillion ..... E04F 13/0814 52/36.6
4,709,517 A * 12/1987 Mitchell ..... E04B 2/7412 52/145
5,127,760 A * 7/1992 Brady ..... E04B 2/825 403/230
5,953,876 A * 9/1999 Agar ..... E04B 2/7409 52/489.1
6,854,230 B2 2/2005 Starke
7,032,356 B2 * 4/2006 Layfield ..... E04B 2/7411 52/404.3
7,461,484 B2 * 12/2008 Battey ..... E04B 2/7425 52/293.3
7,963,080 B1 * 6/2011 Bowman ..... B32B 27/42 52/309.7
9,702,147 B2 * 7/2017 Babson ..... E04B 1/26
9,874,014 B2 1/2018 Reed, II et al.
2005/0034408 A1 * 2/2005 Palumbo ..... E04B 2/7457 52/633
2008/0110126 A1 * 5/2008 Howchin ..... E04C 3/32 52/630
2017/0121968 A1 * 5/2017 Sada ..... E04B 2/707
2019/0040630 A1 * 2/2019 Piethman ..... E04B 2/7425
2019/0376282 A1 12/2019 Michel et al.

OTHER PUBLICATIONS

International Search Report and Written Opinion received for PCT/EP2019/000353, mailed Sep. 1, 2020.

* cited by examiner

DRYWALL AND METHOD FOR CONSTRUCTING A DRYWALL

BACKGROUND

The present invention relates to a drywall comprising a first wall section and a second wall section, as well as a support structure comprising first stud elements, wherein in the area of the first wall section the first stud elements are arranged in a row with first distances and form first support structure bays, wherein a paneling with planking panels is arranged on at least one side of the support structure, and wherein an installation duct is arranged in the second wall section. The invention further relates to a method for erecting such a drywall.

Dry construction refers to the production of construction elements, in particular drywalls, through the assembly of industrially manufactured semi-finished products. Typically, drywalls are created by erecting a support structure of stud elements to which planking panels are attached. In order to achieve a smooth surface, the joints can be provided with a joint filler. Drywalls can be walls in buildings, which are created after the construction of a shell. However, drywalls produced in dry construction can also be used for exterior walls and load-bearing building components if suitable materials are used. A known drywall is described in WO 2013/189855 A.

When constructing drywalls, there is a need to accommodate installations such as electrical, water, sewage, heating, ventilation and air conditioning lines in the drywall. In this context, it has already been proposed to provide the stud elements with cutouts in the profile web through which installation cables can be laid transversely to the stud profiles. This is described, for example, in U.S. Pat. No. 9,874,014. However, the room for installation lines is severely limited because the cut-outs proposed in this patent can only be so large as not to interfere with the static of the stud. Furthermore, cut-outs are often times not reworked and thus have sharp edges that can damage the lines, especially the insulation of electric cables.

It is also known from U.S. Pat. No. 6,854,230 B2 to arrange a hollow head piece, which can accommodate horizontally running cables, on the studs at the upper end of a wall. However, the described construction raises questions concerning the static behavior of such a drywall.

The invention has the object of further developing a drywall in such a way that installations can be easily and safely provided.

SUMMARY

This object is achieved by a drywall having the characteristics of claim 1. Accordingly, the aforementioned drywall is characterised in that the support structure comprises, in the area of the second wall section, a first and a second crossbeam, which, in order to form the installation duct, form a second support structure bay, which extends across at least two first support structure bays that are arranged next to each other. In this way it is possible to accommodate installations with a larger space requirement in the drywall. A support structure bay is delimited in each case by the load-bearing elements of the support structure, which can be formed in particular as stud elements and crossbeams. This means that stud elements and crossbeams form frame sections that completely or partially surround a support structure bay.

The installation duct can be integrated into the drywall in such a way that after the paneling of the drywall the installations are invisibly accommodated in the installation duct. This does not preclude the paneling from having passages for installation elements such as lines, taps or switches. The second support structure bay makes it possible to lay installations also across areas of the wall that are separated from the first stud elements. By designing the support structure as claimed, it is not only possible to create space for voluminous installations in the wall, but at the same time a high stability of the drywall is achieved. In particular, the stud elements do not have to be provided with cutouts, which can considerably reduce the stability of the support structure.

Cutouts are also disadvantageous because they are often sharp-edged and there is a risk of damage, especially to electrical cables, during installation and afterwards. Furthermore, cutouts are not adequate to accommodate installations with large cross-sections, e.g. cable bundles or water lines. Preferably, the first support structure bays are delimited laterally by the first stud elements.

According to an advantageous embodiment of the invention the drywall has a third wall section, wherein the support structure, in the area of the third wall section, has second stud elements arranged in a row with second distances. The second stud elements can delimit third support structure bays. In this way, the installation duct can be provided at a desired position, while at the same time achieving a high level of stability. The first and second distances can be identical, but also different, if desired.

According to a preferred embodiment of the invention, the second wall section is arranged between the first wall section and the third wall section. This embodiment is preferable because it represents the most stable structure, allowing top or bottom ends of the stud elements being received in the ceiling and floor U rail, respectively, typically provided in drywall structures.

According to a further embodiment of the invention, the second support structure bay preferably extends across more than 25%, preferably more than 50%, or more than 70% of the width of the drywall. It is also possible that the second support structure bay extends across the entire width of the drywall.

According to the invention, it is preferred that the first crossbeam and the second crossbeam are arranged opposite to one another, i.e. on opposite sides of the installation duct. Preferably, the first crossbeam is arranged at the bottom and the second crossbeam at the top.

Preferably, the first and second crossbeams extend across at least two, preferably at least three or at least four of the first support structure bays.

It is preferred that the first and/or second crossbeams extend across more than 25%, preferably more than 50%, or more than 70% of the width of the drywall. It is also possible that the first and/or second crossbeams extend across the entire width of the drywall.

Furthermore, the crossbeams can be attached to an adjacent component of the building, such as a pillar or a wall. In doing so, the crossbeams can assume a load-bearing function for the drywall. This also applies in particular to the embodiment in which the support structure of the drywall is designed as a single stud construction. The crossbeams can be attached to the adjacent component, for example, with steel brackets. A single stud construction means a construction having only one row of studs. In contrast a double stud construction means a construction in which two rows of studs are arranged next to each other without actually contacting each other. Double stud constructions are intended to reduce sound transmissions from one room through the drywall into the other room by reducing sound travel paths across the structure.

Preferably, the first and second crossbeams are arranged orthogonal to the first stud elements.

The first crossbeam is preferably arranged at the upper end sections of the first stud elements. The first crossbeam can be arranged lying horizontally on the first stud elements. Preferably, the first crossbeam is connected to the upper end sections of the first stud elements.

The second stud elements can be arranged standing on the second crossbeam. The second crossbeam may be connected in particular to the bottom ends of the second stud elements.

Preferably, the first and second crossbeams can be arranged horizontally. Furthermore, it is preferred for the first stud elements and/or the second stud elements to be arranged vertically.

Preferably, several of the first stud elements are arranged with a regular first distance to adjacent first stud elements. It is also preferred that several of the second stud elements are each arranged with a regular second distance to adjacent second stud elements. Preferably, the first and the second distances are the same.

Preferably, the first and second crossbeams are made of wood or metal.

According to the invention, it is preferred that the first crossbeam and/or the second crossbeam each comprise at least one first crossbeam profile, wherein the crossbeam profile has a first crossbeam profile web and two first crossbeam profile flanges. Preferably, the first crossbeam profile can be formed as a U channel.

The first and/or second crossbeams may comprise a second crossbeam profile having a second crossbeam web and two second crossbeam profile flanges. Preferably, the first and second crossbeam profile webs of the first and second crossbeams are each arranged one on top of the other, wherein the first and second crossbeam profile flanges are pointing in opposite directions. This results in an arrangement "back to back". The crossbeam and the crossbeam profiles can be connected to each other, for example by screw connections. Preferably, the second crossbeam profile is formed as a U channel. For example, installation lines can be accommodated in the second crossbeam profile.

According to another embodiment the second metal crossbeam profile can be used to fix the drywall panels. Typically (but not necessary) the second crossbeam profile is made from thinner gauge metal than the crossbeams, the crossbeams being statically important. For screwing into the crossbeams which typically (but not necessary) are made from light-gauge steel, specialty screws have to be used to penetrate the strong material. When a second metal crossbeam profile of thin sheetmetal is provided the drywall panels can be screwed to these instead of to the crossbeams, and no specialty screws are necessary. This is an advantage on-site because it reduces the number of different items that have to be provided.

Alternatively, the second crossbeam profile can be made of a plastic material, arranged ontop of the lower crossbeam and thus, be used as installation channel. According to European law metal installation channels are not allowed for electric installations so that a plastic material has to be used.

Preferably, it is provided for a material thickness of the first and/or the second crossbeam profile to be between 0.4 mm and 5 mm. In order to achieve high stability, it is preferred that at least one of the first and second crossbeam profiles has a material thickness of between 1 mm and 5 mm.

According to the invention, it is preferred that end sections of the first stud elements are accommodated between the first or second crossbeam profile flanges of the first crossbeam. The end sections of the first stud elements can, for example, simply be inserted between the crossbeam profile flanges.

Similarly, the end sections of the second stud elements can be accommodated between the first or second crossbeam profile flanges of the second crossbeam.

In accordance with a preferred embodiment of the invention, the first crossbeam (preferably the crossbeam profile web of the first crossbeam) may be fitted with a holding means for the installation. The holding means can include, for example, a holding rail, such as a cable duct or a holding bracket. The material of the holding means is basically not limited. It can be plastic or metal, for example. Preferably, the holding means has a width that is smaller than the width of the crossbeam. In this way, the installation can be arranged set back from the paneling. This prevents the installation from being damaged by fasteners inadvertently inserted at this position during paneling.

Preferably, the first and/or second stud elements can be, in particular, wood studs or metal studs.

According to the invention, it is preferred that the first stud element and/or the second stud element are formed as metal stud profiles, each having a stud profile web and two stud profile flanges. The stud profile flanges are preferably arranged at right angles to the stud profile web. Preferably, the first and/or second stud elements are formed as U, C, Ω or M channels. Preferably, the stud profile web is arranged perpendicularly to the surface formed by the planking panels, wherein stud profile flanges are arranged parallel to the surface formed by the planking panels and form a bearing surface for paneling.

Preferably, the material thickness of the stud elements is between 0.4 mm and 5 mm. In particular, the preferred material thickness is between 0.5 mm and 1 mm, if the drywall does not have to meet any special static requirements.

Preferably, it is provided that an electrical line, a water line, a sewage line, a ventilation line, a supply line, a network line and/or a coolant line are arranged in the installation duct.

According to a particularly preferred embodiment the support structure is designed as a double stud construction, wherein a first stud row comprises the first stud elements and the first and second crossbeams and, where applicable, the second stud elements, and wherein a second stud row comprises third stud elements which extend at least across the first and second wall section. The first and second stud rows can be arranged directly next to each other to form the double studs, whereby the first and third stud elements and/or the second and third stud elements form double studs. The third stud elements preferably extend across the entire wall height of the drywall. This embodiment has the advantage that any wall widths and wall heights can be realised, as the third stud elements ensure the stability of the drywall. This makes the drywall particularly stable. It is not necessary for the first and second crossbeams to extend across the full width of the wall.

Preferably, the third stud elements are made of wood or metal.

The third stud elements may comprise stud profiles, each having one stud profile web and two stud profile flanges. Preferably, the third stud elements are formed as U, C, Ω or M channels. C channels are particularly preferred.

The first and third stud elements are preferably arranged in such a way that the stud profile flanges of the first and third stud element are arranged closely to one another, however, preferably without directly contacting each other. The second stud elements are preferably arranged in such a way that the stud profile flanges of the second stud element are closely arranged to the stud profile flanges of the third stud element, however, preferably without actually contacting it.

The third stud elements can be statically connected with the first stud elements and/or with the second stud elements. In this way, firmly connected double studs can be formed. The connection is preferably made by providing panels, for example strips of planking panels, each of which is connected by fasteners, on the one hand, to one of the third and, on the other hand, to one of the first and second stud elements, respectively. The panel strips can extend over the profile webs of the first and third stud elements or over the profile webs of the second and third stud elements. It is particularly preferred to attach (in particular screw) a panel strip to the stud profile webs of two stud elements arranged parallel to each other so that the two stud elements are firmly connected to each other.

Direct contact between double studs, i.e. between first an third stud elements or second and third stud elements can be prevented for example by interposing an elastic intermediate layer or by arranging the studs with a small gap. These measures greatly improve the sound insulation properties of the drywall.

The first and second stud elements can be firmly connected to the first and/or second crossbeams. This can be achieved in particular by inserting the end sections of the respective stud element into the respective crossbeam and connecting them to it (in particular to the crossbeam profile flanges). Fastening can be done, for example, by crimping or screwing.

According to the invention, fasteners can be provided which connect the paneling with the first stud elements, the first and second crossbeams or second metal crossbeam profile and, where applicable, with the second and third stud elements. A portion of the fasteners in the first crossbeams also connects the first crossbeam to the first stud elements. A portion of the fasteners in the second crossbeams also connects the second crossbeam to the second stud elements. The fasteners can be screws or nails, for example. In addition, adhesive can be used. In principle, any sufficiently strong fastening of the paneling known to one skilled in the art is possible.

According to the invention, the planking panels can comprise drywall panels, whereby gypsum boards, gypsum plasterboards, gypsum fibreboards and fibre-cement boards are particularly preferred. However, wood panels, chipboard panels or other planking panels can also be used for paneling.

The object of the invention is also solved by a method with the characteristics of claim 15. Accordingly, it is provided that the method of erecting a drywall comprises erecting a support structure, wherein, in the area of a first wall section, first stud elements with first distances are arranged which form first support structure bays, wherein, in the area of a second wall section, a first and a second crossbeam are arranged, so that, in order to form an installation duct, the support structure has a second support structure bay which extends across at least two first support structure bays that are arranged next to each other, wherein an installation is arranged in the installation duct and wherein a paneling of planking panels is arranged on at least one side of the support structure.

Further advantageous characteristics of the method can also be derived from the description of the drywall.

Further goals, characteristics, advantages and application possibilities of this invention result from the following description of exemplary embodiments based on the drawings. All described and/or depicted characteristics, individually or in any meaningful combination, form the object of the invention, also independently of the summary in individual claims or their back references.

DETAILED DESCRIPTION

Figure 1:
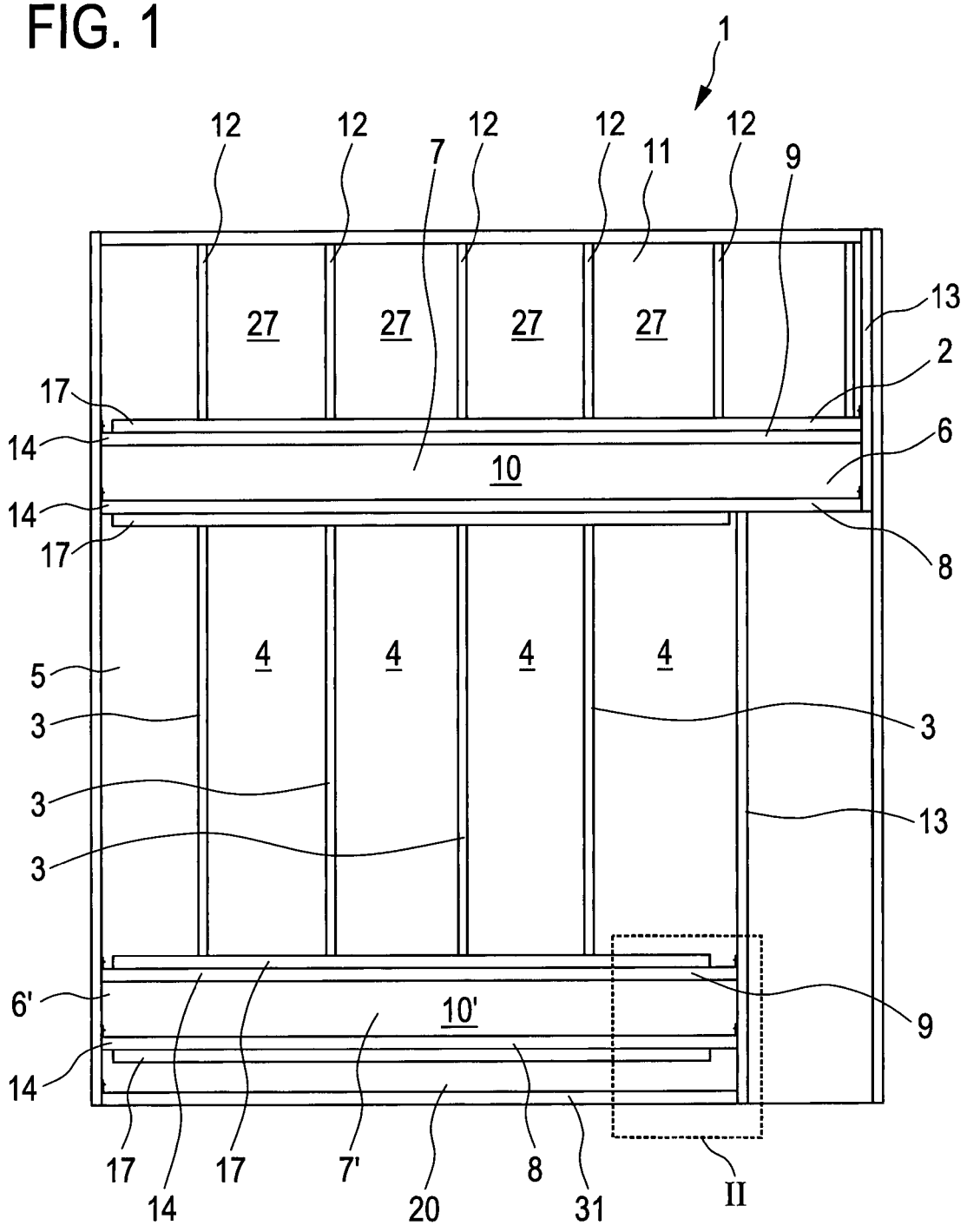
FIG. 1: a first embodiment of a drywall in front view.

FIG. 1 shows a first embodiment of a drywall 1. In order to be able to display the structure of the drywall 1, the drywall 1 is shown without paneling.

The drywall 1 comprises a support structure 2, which comprises first stud elements 3. The first stud elements 3 are arranged in a row with first distances and form first support structure bays 4. The first stud elements 3 are arranged vertically. In each case, two first stud elements 3 delimit a first support structure bay 4 that is positioned between them.

The first stud elements 3 are arranged in a first wall section 5 of the drywall 1. The drywall 1 also has second wall sections 6, 6', in each of which an installation duct 7 is arranged. In the area of the second wall sections 6, 6', the support structure 2 has a first crossbeam 8 and a second crossbeam 9, respectively. These form second support structure bays 10, 10', which in each case extend across several first support structure bays 4 arranged next to each other. In this way, an integrated, continuous installation duct 7 is created in the area of each of the second support structure bays 10, 10', so that installations can be arranged inside the drywall 1. The depicted embodiment shows that installations with a larger space requirement can be accommodated inside the drywall 1.

The drywall 1 also has a third wall section 11, whereby the support structure 2 has second stud elements 12 in the area of the third wall section 11. These are arranged vertically in a row next to each other with second distances between the individual stud elements 12. Third support structure bays 27 are formed between the second stud elements 12. In the example shown here, the distances between the first stud elements 3 and the second stud elements 12 are equal. The second stud elements 12 are aligned with the first stud elements 3.

FIG. 1 further shows that the second wall section 6 is located between the first and third wall sections 5, 11. In the embodiment shown, the second support structure bay 10 extends across the entire width of the wall. The second wall section 6' is arranged under the first wall section 5. The second support structure bay 10' is slightly shorter.

In each case, the first crossbeam 8 is located on the bottom side of the installation duct 7, while the second crossbeam 9 is located on the upper side of the installation duct 7.

The second stud elements 12 are arranged standing on the second crossbeam 9 of the second wall section 6. The first stud elements 3 are arranged standing on the second crossbeam 9 of the second wall section 6' or in a floor rail.

The first and second crossbeams 8, 9 are arranged horizontally.

In the embodiment shown in FIG. 1, the first and second crossbeams 8, 9 are each connected at their ends with an adjacent component 13 in a load-bearing manner. In this way, the crossbeams 8, 9 can absorb the occurring forces and transfer them to the adjacent component 13. In the embodiment shown, the load-bearing component 13 is only shown schematically. The load-bearing component 13 can, for example, be the wall of a building, the pillar of a building, a continuous stud or the like.

The first and second stud elements 3, 12 and the first and second crossbeams 8, 9 may be made of wood, steel or any other sufficiently strong material. In the embodiment shown, the first and second crossbeams 8, 9 each have a first metal crossbeam profile 14. The first crossbeam profile 14 may have a first crossbeam profile web 15 (see FIG. 2) and two first crossbeam profile flanges 16 arranged thereon. In the embodiment shown, the first crossbeam profile 14 is formed as a U channel. The first crossbeam profile 14 can be formed as a U stiffening channel (also known as a UA channel). Compared to a U wall channel (also known as a UW channel), it has an increased load-bearing capacity. Accordingly, the first crossbeam profile 14 has a material thickness of between 1 mm and 5 mm, whereas the first and second stud elements 3, 12 has a material thickness of between 0.4 mm and 1 mm.

The first and second crossbeam 8, 9 in the embodiment shown in FIG. 1 each also comprise a second crossbeam profile 17. The second crossbeam profile 17 is made of metal and each has a second crossbeam profile web 18 and two second crossbeam profile flanges 19 arranged thereon.

The first and second crossbeam profiles 14, 17 are arranged on top of each other, with the first and second crossbeam profile webs 15, 18 abutting each other and the first and second crossbeam profile flanges 16, 19 pointing in opposite directions. Thus, the first and second crossbeam profiles 14, 17 are arranged "back to back". Preferably, the second crossbeam profile 17 is formed as a U channel. Since in the embodiment shown, the first crossbeam profile 14 assumes a load-bearing function, it is sufficient for the second crossbeam profile 17 to be formed as a U wall channel and to have a material thickness of between 0.4 mm and 1 mm.

FIG. 1 further shows that the second crossbeam profiles 17 in the area of the second wall section 6 are arranged such that the second crossbeam profile flanges 19 point to the first support structure bays 4 and to the third support structure bays 27 respectively. In this way, the first stud element 3 can be accommodated between the second crossbeam profile flanges 19. The second crossbeam profiles 17 are provided in order to allow to slideably insert the first and second stud elements 3, 12 between its flanges which would not be possible with the stronger U channels 14 due the inflexibility of its flanges and its inner dimension. The inner dimension of the U channels 14 is smaller than in the same size second crossbeam profiles 17 due to their higher material thickness.

Similarly, in the area of the third wall section 11, the second crossbeam profile 17, which is arranged on the second crossbeam 9, is arranged in such a way that the lower ends of the second stud elements 12 are received between the second crossbeam profile flanges 19.

The first and second crossbeam profiles 14, 17 can be joined together with fasteners, such as screws, nails, brackets, glue or the like.

FIG. 1 further shows that below the lower second wall section 6, a fourth wall section 20 is formed which extends parallel to the second wall section 6. Here, too, there is a cavity that can be used for installations.

The first and second stud elements 3, 12 are formed as metal stud profiles in the embodiment shown, each of which has a stud profile web and stud profile flanges arranged thereon. The stud profiles can in particular be C wall channels (also referred to as CW channels). The material thickness of the stud profiles can be between 0.4 mm and 5 mm, whereby a material thickness of 0.5 mm to 1 mm is generally sufficient for drywalls, which do not have a load-bearing function in a building. However, the metal stud profiles can also have other cross-sectional shapes, such as a U, Ω or M channel in particular.

In the second wall sections 6, 6', there is sufficient space to arrange installations, such as electrical lines, water lines, sewage lines, ventilation lines, supply lines and/or coolant lines, invisibly inside the drywall 1. It is advantageous that the installation lines in this area do not have to be threaded through openings in the profiles, whereby they can be damaged.

Figure 2:
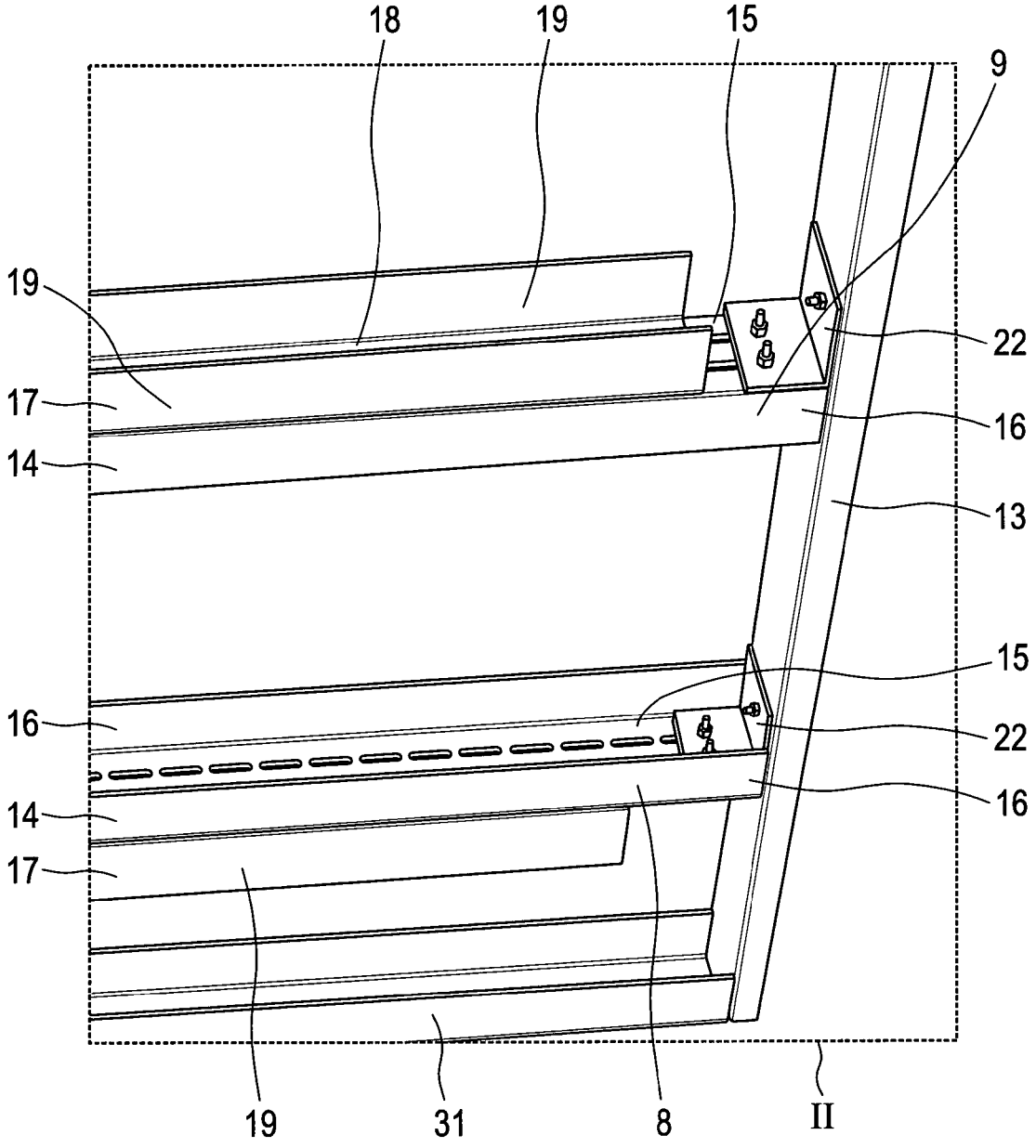
FIG. 2: the enlarged detail II from the drywall of FIG. 1.

FIG. 2 shows the enlarged detail II from FIG. 1 in perspective view. In particular, it is shown that the first and second crossbeams 8, 9 each have a first and a second crossbeam profile 14, 17. In addition, the arrangement of the first and second crossbeam profiles 14, 17 "back to back" can be clearly seen.

Furthermore, FIG. 2 shows how the first and second crossbeams 8, 9 are attached to one side of the load-bearing component 13 by brackets or angles 22. A corresponding fastening is provided on the opposite side of the drywall 1.

FIG. 2 also shows that the upward pointing first crossbeam profile flanges 16 of the first crossbeam 8 form a space in which installations, such as electrical cables and the like, can be arranged horizontally. The first crossbeam profile flanges 16 not only ensure that the installations remain in the desired position, they also protect them from damage at the same time. When electrical cables are to be installed in this channel a plastic lining is advisable in order to prevent short-cuts from damaged cables.

The support structure 2 shown in FIGS. 1 and 2 can be fitted with a paneling, which comprises planking panels, in the usual way. The planking panels can be in particular gypsum boards, gypsum plasterboards, gypsum fibreboards or fibre-cement boards. The planking panels can be connected with fasteners, such as screws, to the first and second stud elements 3, 12 as well as to the first and/or second crossbeam profiles 14, 17. Preferably, they are fixed to the second crossbeam profiles 17 which have a lower material gauge. The paneling stiffens the drywall 1, so that despite the continuous horizontal second wall sections 6, 6' with the installation ducts 7, a high stability of the drywall 1 results. The embodiment shown in FIGS. 1 and 2 with paneling on one side is particularly suitable as a facing shell in front of existing walls. However, it can also be used as a partition wall with paneling on both sides.

Figure 3:
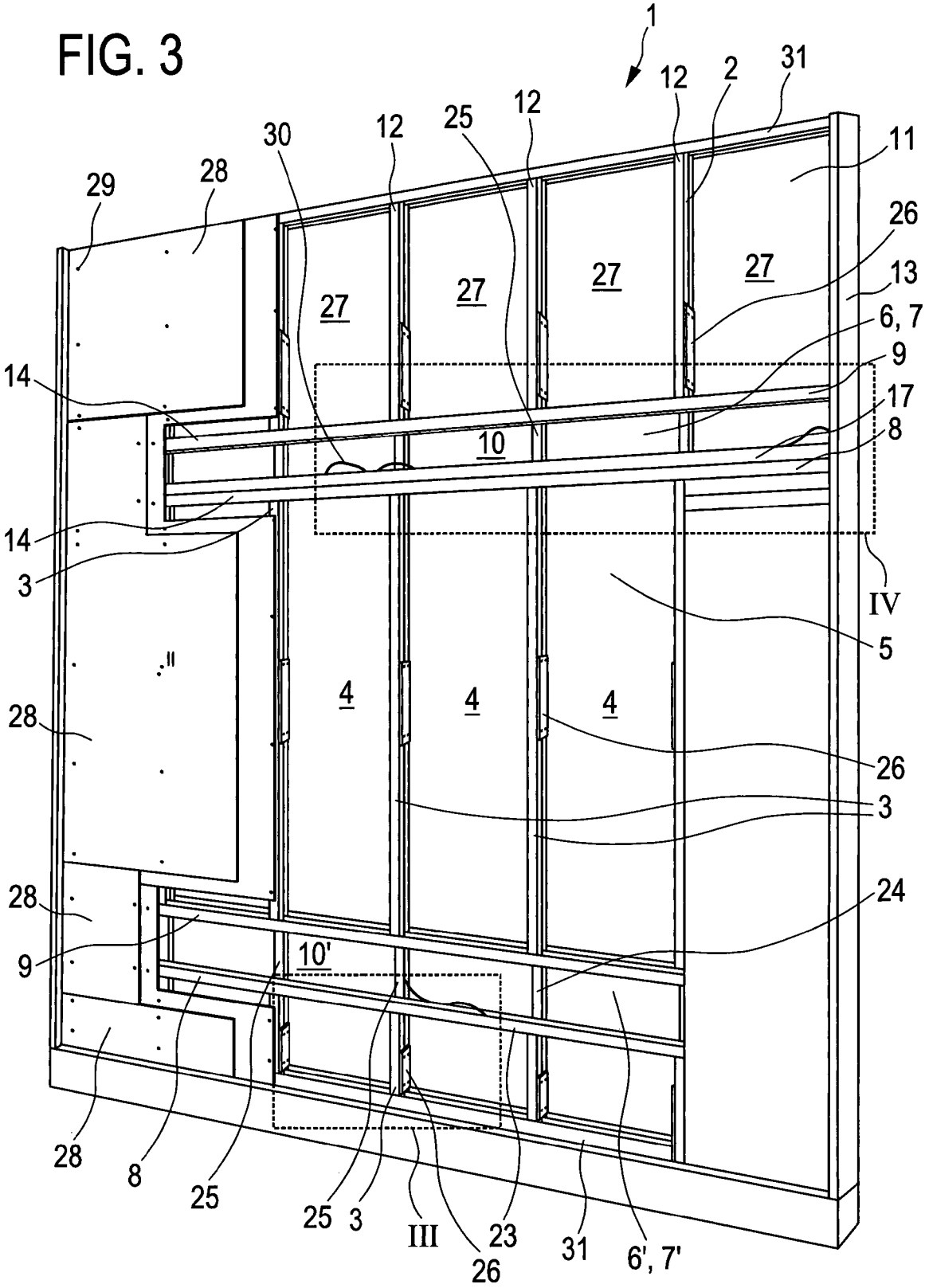
FIG. 3: a perspective representation of a second embodiment of a drywall.
Figure 4:
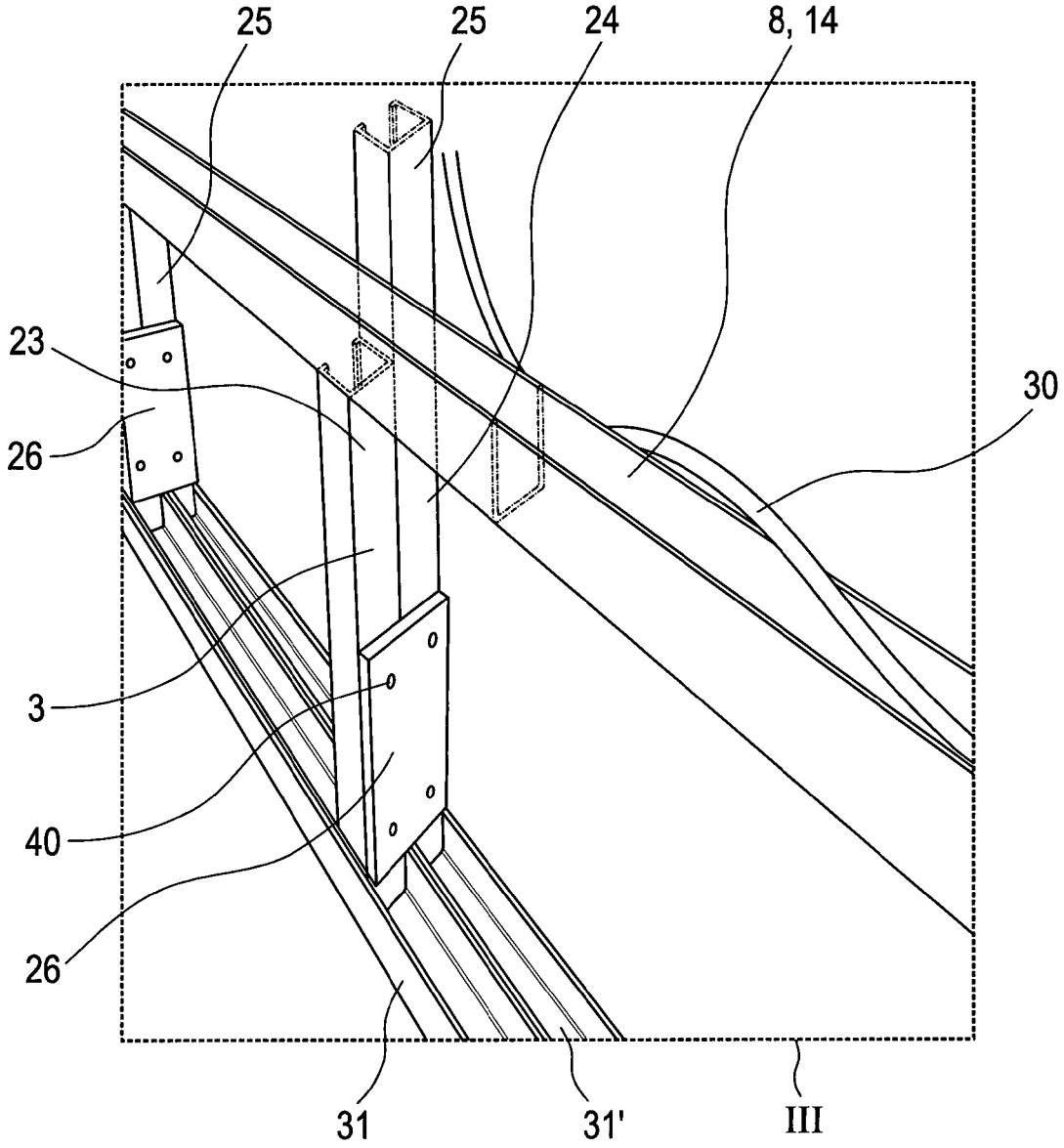
FIG. 4: the enlarged detail III from the drywall of FIG. 3.
Figure 5:
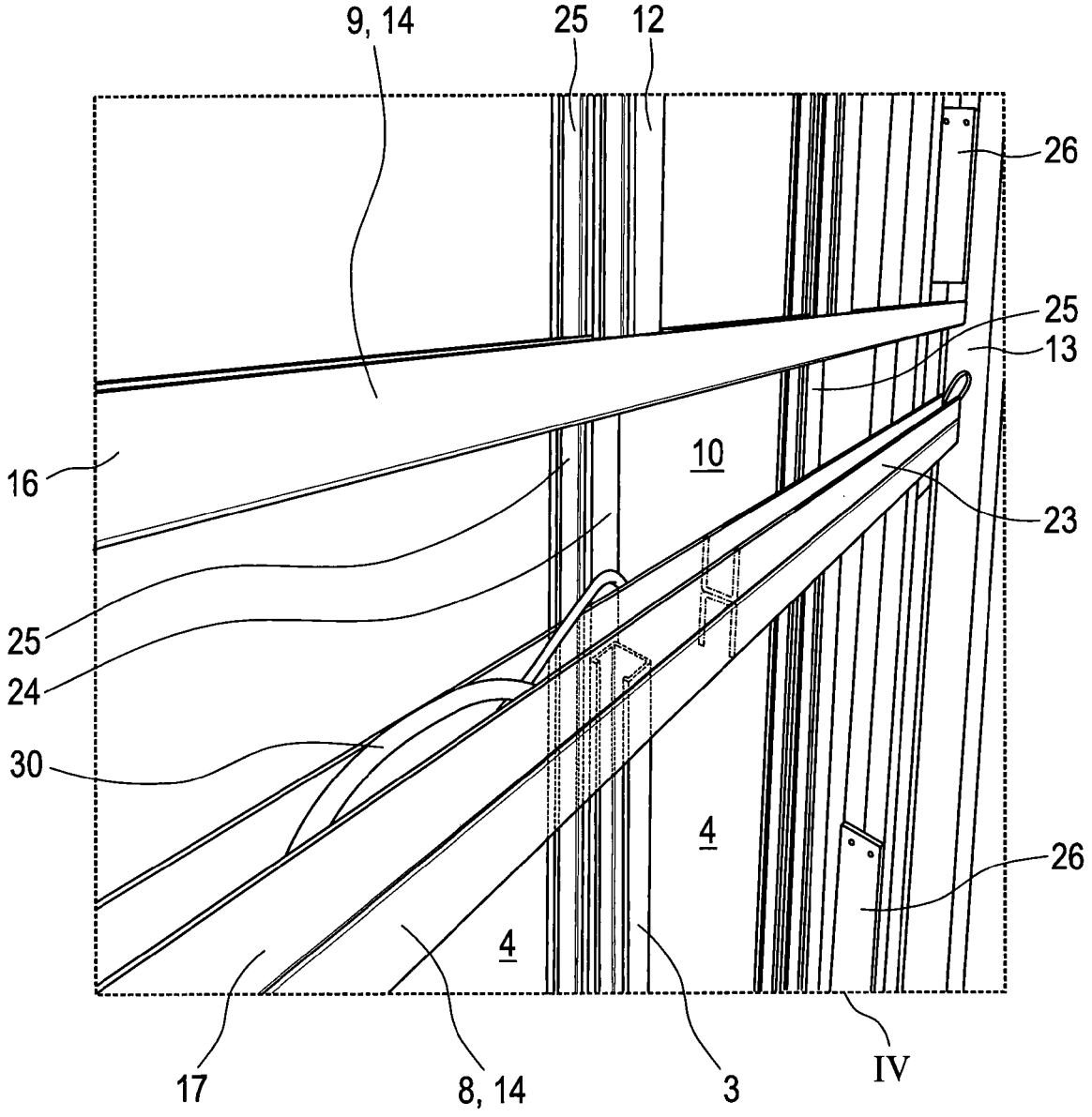
FIG. 5: the enlarged detail IV from the drywall of FIG. 3.

FIGS. 3 to 5 show another embodiment of the invention. Since it has substantial similarities with the embodiment from FIGS. 1 and 2, the same reference signs are used for parts with the same function. Where there are similarities, the description of FIGS. 1 and 2 shall apply accordingly to FIGS. 3 to 5.

The embodiment shown in FIGS. 3 to 5 differs from that shown in FIGS. 1 and 2 in that the support structure 2 has a first row of studs 23 and a second row of studs 24. In the first row of studs 23, the first and second stud elements 3, 12 with the first and second crossbeams 8, 9 are arranged as described in connection with FIGS. 1 and 2. In the second row of studs 24, the support structure 2 has additional third stud elements 25. The third stud elements 25 extend continuously across the entire height of the drywall 1 and thus also cover the first, second and third wall sections 5, 6, 6', 11. The third stud elements 25 give the support structure 2 additional stability. It is therefore not necessary to attach the first and second crossbeams 8, 9 laterally to a load-bearing component 13, as shown in FIG. 2. This allows drywalls to be constructed in any width and it is not necessary for the first and second crossbeams to be so long that they can cover the entire wall width without interruption. The embodiment shown in FIGS. 3 to 5 thus provides additional flexibility, although the two-layer design of the support structure 2 results in a somewhat greater minimum wall thickness. This embodiment is particularly suitable as a partition wall with paneling on both sides.

The third stud element 25, like the first and second stud elements 3, 12, can be formed as metal stud profiles. Reference is made to the above description of the stud profiles, which also applies to the third stud elements 25.

The first and second stud elements 3, 12 are arranged directly next to the third stud elements 25, almost abutting but preferably not actually contacting them. The first and third stud elements 3, 25 and the second and third stud elements 12, 25, respectively, are aligned parallel to each other. The first and second stud elements 3, 12 are each statically connected to an adjacent third stud element 25. In the embodiment shown, panel strips 26 are provided for connection. These can be, for example, strips of planking panels. The planking strips 26 connect the first and third stud elements 3, 25 and the second and third stud elements 12, 25, respectively, arranged next to each other. If the stud elements are metal profiles, the profiles are preferably arranged in such a way that the flanges of both studs are next to each other.

Furthermore, FIG. 3 shows that the first crossbeam 8 of the second support structure bay 10 has a first and a second crossbeam profile 14, 17. The second crossbeam 9, on the other hand, has only the first crossbeam profile 14. Since in the embodiment shown in FIGS. 3 to 5, the support structure 2 is given additional stability by the third stud elements 25, U wall channels with a lower material thickness can be used for the first and second crossbeams 8, 9. The U stiffening channels, which have a greater material thickness and thus a higher load-bearing capacity, are generally not required, but can also be used.

In addition to the upper installation duct 7, the embodiment shown in FIG. 3 also has a lower installation duct 7'. In case of the lower installation duct 7', the first crossbeam 8 does not have a second crossbeam profile 17.

FIG. 3 also shows in a section on the left how a two-layer paneling 28 can be arranged on the support structure 2. The position of fasteners 29, which e.g. could be formed as screws, is also shown schematically. In the finished state, the drywall 1 is on both sides completely covered with two layers of paneling 28 each.

FIGS. 4 and 5 show the sections III and IV of the drywall 1 from FIG. 3. Here, the double stud design of the support structure 2 can be clearly seen, having the first and third and second and third stud elements 3, 12, 25, respectively, arranged next to each other, forming double studs. The connection of the stud elements 3, 12, 25 with the panel strips 26 is also shown. FIGS. 4 and 5 also show how an installation, such as an electrical cable 30, can be arranged inside the drywall 1. The double stud design has the advantage that installations can also be guided vertically without any problems because the installation duct 7 is only present in one half of the interior space of the drywall 1. In the other half, the installation can easily be guided laterally past the crossbeams 8, 9.

Furthermore, FIG. 4 shows that the first and third stud elements 3, 25 can be accommodated at their lower ends in U rails 31. U rails 31 can also be provided at the upper end of the drywall 1 in typical manner.

FIG. 5 again clearly shows the double stud construction of the drywall 1, whereby the first and second stud elements 3, 12 and the crossbeams 8, 9 are located in the first row of studs 23. In the second row of studs 24, the continuous third stud elements 25 are provided. In FIG. 5 however, the second row of studs 24 is behind the first row of studs 23.

Furthermore, it is shown how the first and the second crossbeams 8, 9 are arranged. The first crossbeam 8 comprises, as described above, a first and a second crossbeam profile 14, 17, which are formed as U channels. The orientation of the U channels is illustrated by dashed lines. It is also shown that the upper ends of the first stud elements 3 are accommodated between the first crossbeam profile flanges 16. The U channel 17 serves as a receiving element and guide for the installation 30. It is formed from plastic.

The invention claimed is:

1. A drywall comprising: a first wall section and a second wall section, as well as a support structure comprising first stud elements; wherein in an area of the first wall section, the first stud elements are arranged in a row with first distances and form first support structure bays; wherein a paneling with planking panels is arranged on at least one side of the support structure; wherein an installation duct is arranged in the second wall section; the support structure having, in an area of the second wall section, a first and a second crossbeam, which, to form the installation duct, forms a second support structure bay which extends across at least two first support structure bays that are arranged next to each other, wherein the first crossbeam comprises at least one first metal crossbeam profile with a first crossbeam profile web and two first crossbeam profile flanges into which installations are configured to be arranged horizontally, and wherein the first crossbeam comprises at least one second metal crossbeam profile which has a thickness that is greater than a thickness of the first stud elements.

2. The drywall according to claim 1, characterised in that the drywall has a third wall section, wherein the support structure, in the area of the third wall section, has second stud elements arranged in a row with second distances.

3. The drywall according to claim 2, characterised in that at least one of:

the second wall section is located between the first and third wall sections; and the second stud elements are arranged standing on the second crossbeam.

4. The drywall according to claim 1, characterised in that the first crossbeam is arranged on one side of the installation duct and the second crossbeam is arranged on the other side of the installation duct.

5. The drywall according to claim 1, characterised in that the first and the second crossbeams extend across at least two of the first support structure bays.

6. The drywall according to claim 1, characterised in that at least one of:

the first and second crossbeams are arranged orthogonal to the first stud elements; and the first and/or the second crossbeams are each connected at their ends to an adjacent component in a load-bearing manner.

7. The drywall according to claim 1, characterised in that the second crossbeam comprises at least one of the first metal crossbeam profile, such that the two first crossbeam profile flanges of the second crossbeam are directed downward and face the two first crossbeam profile flanges of the first crossbeam.

8. The drywall according to claim 1, characterised in that the second crossbeam profile that has a second crossbeam profile web and two second crossbeam profile flanges which face an opposite direction of the two first crossbeam profile flanges.

9. The drywall according to claim 1, characterised in that a holding means for the installation is arranged on the first crossbeam.

10. The drywall according to claim 1, characterised in that the first stud element and/or the second stud element are formed as metal stud profiles each having a stud profile web and two stud profile flanges.

11. The drywall according to claim 1, characterised in that the support structure has a first and a second row of studs, wherein the first row of studs comprises the first stud elements and the first and second crossbeams, and wherein the second row of studs comprises third stud elements which extend at least across the first and the second wall section.

12. The drywall according to claim 11, characterised in that the third stud elements are statically connected to the first stud elements and/or to the second stud elements.

13. A method for erecting a drywall, comprising: erecting a support structure, wherein, in an area of a first wall section, first stud elements with first distances are arranged forming first support structure bays; in an area of a second wall section, a first and a second crossbeam are arranged, so that, in order to form an installation duct, the support structure has a second support structure bay, which extends across at least two first support structure bays that are arranged next to each other; wherein an installation is inserted in the installation duct; wherein a paneling of planking panels is arranged on at least one side of the support structure; and wherein the first crossbeam comprises at least one first metal crossbeam profile with a first crossbeam profile web and two first crossbeam profile flanges into which installations are configured to be arranged horizontally, and wherein the first crossbeam comprises at least one second metal crossbeam profile which has a thickness that is greater than a thickness of the first stud elements.

14. The method for erecting a drywall according to claim 13, characterised in that at least one of the first crossbeam and the second crossbeam comprises a second crossbeam profile that has a second crossbeam profile web and two second crossbeam profile flanges.

15. The drywall according to claim 1, characterised in that the at least one first crossbeam profile is formed as a U channel.

16. The drywall according to claim 1, characterised in that the second support structure bay extends across more than 50% of the width of the drywall.

17. The drywall according to claim 1, characterised in that the second support structure bay extends across the entire width of the drywall.

18. A drywall comprising: a first wall section and a second wall section, as well as a support structure comprising first stud elements; wherein in an area of the first wall section, the first stud elements are arranged in a row with first distances and form first support structure bays; wherein a paneling with planking panels is arranged on at least one side of the support structure; wherein an installation duct is arranged in the second wall section; the support structure having, in an area of the second wall section, a first and a second crossbeam, which, to form the installation duct, forms a second support structure bay which extends across at least two first support structure bays that are arranged next to each other, wherein the support structure has a first row of studs and a second row of studs, wherein the second row of studs is next to and behind the first row of studs, wherein the first row of studs comprises the first stud elements and the first and second crossbeams, and wherein the second row of studs comprises third stud elements which extend at least across the first and the second wall section.

19. The drywall according to claim 18, characterised in that the second support structure bay extends across more than 50% of the width of the drywall.

20. The drywall according to claim 18, characterised in that the second support structure bay extends across the entire width of the drywall.

* * * * *